US010284971B2

(12) United States Patent
Secall et al.

(10) Patent No.: US 10,284,971 B2
(45) Date of Patent: May 7, 2019

(54) HEARING ASSISTANCE METHOD

(71) Applicant: Sonova AG, Stäfa (CH)

(72) Inventors: Marc Secall, Constantine (CH); Hans-Ueli Roeck, Hombrechtikon (CH); Francois Callias, Fontaines NE (CH); Manuela Feilner, Egg Bei Zürich (CH)

(73) Assignee: Sonova AG, Stäfa (CH)

( * ) Notice: Subject to any disclaimer, the term of this patent is extended or adjusted under 35 U.S.C. 154(b) by 190 days.

(21) Appl. No.: 15/510,342

(22) PCT Filed: Oct. 2, 2014

(86) PCT No.: PCT/EP2014/071191
§ 371 (c)(1),
(2) Date: Mar. 10, 2017

(87) PCT Pub. No.: WO2016/050312
PCT Pub. Date: Apr. 7, 2016

(65) Prior Publication Data

US 2017/0311092 A1 Oct. 26, 2017

(51) Int. Cl.
*H04R 25/00* (2006.01)
*G10L 25/60* (2013.01)

(52) U.S. Cl.
CPC ..... *H04R 25/505* (2013.01); *G10L 25/60* (2013.01); *H04R 25/405* (2013.01);
(Continued)

(58) Field of Classification Search
CPC .... H04R 25/405; H04R 25/407; H04R 25/43; H04R 25/505; H04R 25/552;
(Continued)

(56) References Cited

U.S. PATENT DOCUMENTS 6,687,187 B2 2/2004 Roeck
8,150,057 B2 4/2012 Dunn
(Continued)

FOREIGN PATENT DOCUMENTS

EP 1 657 958 B1 6/2012
JP 2014-49854 A 3/2014
(Continued)

*Primary Examiner* — Huyen D Le

(57) ABSTRACT

A method of providing hearing assistance to a at least one user wearing at least one receiver hearing assistance device from at least one audio transmission device worn by a another user, involving: automatically pairing and connecting the audio transmission device with the receiver hearing assistance device to form an ad-hoc network for exchanging network and/or control information, estimating at least one of an angular direction of the audio transmission device with regard to a viewing direction of the user of the receiver hearing assistance device and an angular direction of the receiver hearing assistance device with regard to a viewing direction of the user of the audio transmission device, admitting the audio transmission device to a wireless local acoustic area network for exchanging audio signals only if, as a predefined admission rule, the transmission device is within a field of view of one of the users.

31 Claims, 6 Drawing Sheets

(52) U.S. Cl.
CPC ..... *H04R 25/407* (2013.01); *H04R 25/552* (2013.01); *H04R 25/554* (2013.01); *H04R 25/43* (2013.01); *H04R 2225/43* (2013.01); *H04R 2225/55* (2013.01)

(58) Field of Classification Search
CPC ..... H04R 25/554; H04R 2225/43; H04R 2225/55; H04R 2420/07
USPC ..... 381/23.1, 60, 312, 313, 314, 315, 91, 92
See application file for complete search history.

(56) References Cited

U.S. PATENT DOCUMENTS

| | | | | |
|---|---|---|---|---|
| 8,620,013 | B2 | 12/2013 | Roeck | |
| 9,215,535 | B2 * | 12/2015 | Oesch | H04R 25/407 |
| 2011/0301730 | A1 | 12/2011 | Kemp et al. | |
| 2012/0189140 | A1 | 7/2012 | Hughes | |
| 2012/0314890 | A1 | 12/2012 | El-Hoiydi et al. | |
| 2012/0321112 | A1 | 12/2012 | Schubert et al. | |
| 2014/0219485 | A1 | 8/2014 | Jensen et al. | |
| 2015/0016644 | A1 * | 1/2015 | Strelcyk | H04R 25/50<br>381/314 |
| 2017/0105074 | A1 * | 4/2017 | Jensen | H04R 25/405 |
| 2018/0020298 | A1 * | 1/2018 | Courtois | H04R 25/552 |

FOREIGN PATENT DOCUMENTS

| | | | |
|---|---|---|---|
| WO | 2011/015675 | A2 | 2/2011 |
| WO | 2011/098142 | A1 | 8/2011 |

* cited by examiner

HEARING ASSISTANCE METHOD

BACKGROUND OF THE INVENTION

Field of the Invention

The invention relates to a hearing assistance system comprising at least one audio transmission device for capturing an audio signal from a person's voice and at least one hearing assistance device for receiving audio signals from such audio transmission devices, with each device comprising a wireless network interface for establishing a wireless local acoustic area network (LAAN).

Description of Related Art

In general, LAANs serve to exchange audio signals between audio devices used by different persons communicating with each other. When forming a LAAN, the respective audio devices have to be paired and connected via a wireless link to each other, and regulations have to be provided as to which audio device is allowed when to transmit which audio signals to which device.

An example of a LAAN formed by hearing aids and wireless microphones is described in International Patent Application Publication WO 2011/098142 A1 and corresponding U.S. Patent Application Publication 2012/314890, wherein a relay device is provided for mixing audio signals from various wireless microphones by applying different weights to each signal. Another example of a LAAN formed by hearing aids and wireless microphones is described in Patent Application Publication WO 2010/078435 A2 and corresponding U.S. Pat. No. 8,150,057. European Patent Application EP 1 657 958 B1 A2 and corresponding U.S. Pat. No. 8,620,013 relate to an example of a wireless LAAN formed by hearing aids.

U.S. Patent Application Publication 2012/0189140 A1 relates to a LAAN formed by a plurality of personal electronic devices, such as smartphones and hearing aids, wherein two devices may be paired by spatial proximity, wherein the audio receiving devices may mute or selectively emphasize or deemphasize the individual input audio streams, and wherein the audio transmitting device may mute its audio-transmission depending on the handling by its user (for example, when worn in a pocket) or depending on the kind of sampled audio signal.

U.S. Patent Application Publication 2012/0321112 A1 relates to a method of selecting an audio stream from a number of audio streams provided to a portable audio device, wherein the audio stream may be selected based on the signal strength of wireless connections, the direction in which the device is pointed, and images obtained from a camera; the audio receiving device may be a smartphone which transmits the received selected audio stream to a hearing aid.

U.S. Pat. No. 6,687,187 B2 relates to a method of locating an electromagnetic or acoustic signal source depending on its angular location.

International Patent Application Publication WO 2011/015675 A2 and corresponding U.S. Pat. No. 9,215,535 relate to a binaural hearing aid system and a wireless microphone, wherein the angular location of the wireless microphone is estimated in order to supply the received audio signal in such a manner to the hearing aids that an angular location impression corresponding to the estimated angular location of the wireless microphone is simulated.

SUMMARY OF THE INVENTION

It is an object of the invention to provide for a hearing assistance method and system, wherein a plurality of audio signal transmission and audio system transceiver devices form a wireless LAAN, and wherein the devices can be used in a particularly convenient manner.

According to the invention, this object is achieved by a method and a system as described herein.

The invention is beneficial in that, by automatically pairing the devices and connecting the paired devices in an ad-hoc network and admitting the devices to a LAAN based on admission rules comprising the estimated angular direction of a device with regard to the viewing direction of the user of another device, the devices do not require user input for forming and managing the network, thereby making use of the devices particularly convenient, while it is nevertheless ensured that the respective user can be provided with only those audio signals which are of interest to him, while data traffic, and thus, power consumption and network congestion can be minimized.

Preferably, an automatic transmission enable mode is implemented in which the audio signal is transmitted only in case that certain transmission conditions, such as a mutual viewing angle between the transmission device user and at least one receiver device user, the level and/or quality of the audio signal captured by the transmission device, the distance between the transmission device and the receiver device(s), and/or the quality of the RF link from the transmission device or the receiver devices(s), are fulfilled. Thereby, the user of the transmission device can be assured that his microphone signal is transmitted only to desired receivers nearby. Thus, he is aware of who is listening to his voice in this aided manner, and intelligibility of the transmitted audio signals can be ensured. Further preferred embodiments of the invention are defined in the dependent claims.

Hereinafter, examples of the invention will be explained by reference to the accompanying drawings.

DETAILED DESCRIPTION OF THE INVENTION

Figure 1:
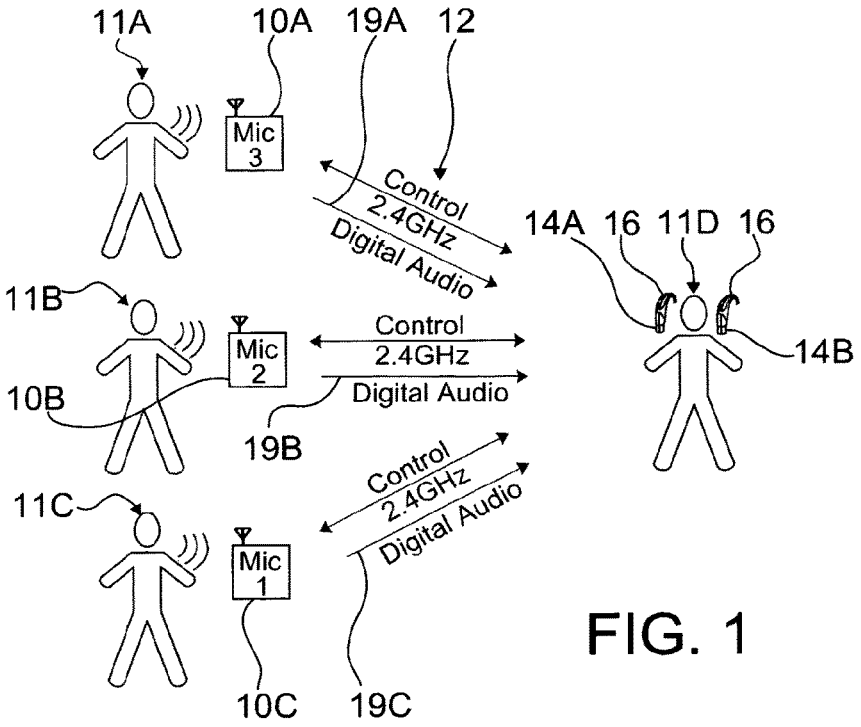
FIG. 1 is a schematic view of an example of a hearing assistance system according to the invention.

The invention relates to a hearing assistance system comprising at least one audio transmission device capable of capturing an audio signal from a person's voice and at least one hearing assistance device to be worn by a user for receiving audio signals from audio transmission devices, each of the devices comprises a wireless network interface for establishing a wireless LAAN. The wireless network may use a standard protocol, such as a Bluetooth protocol, in particular Bluetooth low energy, or it may use a proprietary protocol; typically, a frequency hopping algorithm will be used, operating, for example, in the 2.4 GHz ISM band.

As used hereinafter, hearing assistance devices includes all kinds of ear level audio devices such as hearing aids in different form factors, cochlear implants, wireless earbuds, headsets or other such devices. Preferably, also the audio transmission device is one of such hearing assistance devices. In particular, the audio transmission devices may be provided in pairs, each pair forming a binaural system.

Such devices may incorporate for their normal function at least one of microphone(s), speakers, user interface, amplification for, e.g., hearing loss compensation, sound level limiters, noise cancelling, feedback cancelling, beamforming, frequency compression, logging of environmental and/or user control data, classification of the ambient sound scene, sound generators, binaural synchronization and/or other such functions, which may get influenced by the inventive functionality as described here or which may influence the inventive function.

Transmission devices to be used in such a network may include mobile handheld devices or body-worn devices; in particular, while the transmission devices preferable are hearing assistance devices, in some cases the audio transmission devices may be wireless microphones, audio streamer devices or audio communication devices such as mobile phones or other mobile commercial electronic devices, such as "smart watches" or "smart glasses". The transmission device may comprise at least one integrated microphone or at least one microphone connected to the device via a cable connector.

The audio receiver devices may be adapted to be worn at or at least in part in an ear of the user; in particular, the receiver devices may be provided in pairs, each pair forming a binaural system, with one of the devices being worn at one of the ears and the other device being worn at the other ear. In particular, the receiver devices may be hearing aids, auditory prostheses, a headset or headphones. In order to form a local acoustic area network (LAAN), the audio devices have to form a group or subgroup of devices by automatically pairing and connecting on a service level with other devices in range in order to exchange network and other information to form an ad-hoc network, wherein a device is subsequently admitted to the LAAN network only if predefined admission rules are fulfilled, with the admission rules comprising the mutual viewing directions of the user of the respective device According to the LAAN admission rules, a (new) device is admitted only if the device is in a field of view of a user of one of the devices already present in the LAAN and vice versa, i.e., the potential new network participant is viewing at that same already participating user, with the field of view being defined as an angular sector centered around the viewing direction of the user. The field of view of the user of a device is indicative of the user's interest in the users of other audio devices, i.e., potential talkers/listeners, so that it is reasonable to admit only those devices into the network which are in the field of view of a user of one of the already admitted devices, with such devices qualifying as devices potentially useful for the network.

The relative orientation of the devices, i.e., the angular direction, may be estimated, for example, based on a difference of a signal strength parameter, such as an RSSI value, of an RF signal emitted by the (new) device and received by a first audio receiver device worn at one ear of the user (whose devices already have been admitted to the network) and a second audio receiver device worn at the other ear of the user. A small difference indicates a new device being in the front or back of the user, whereas a big difference indicates a new device on the side of the user, with the ipsilateral device receiving the stronger RSSI. According to another example, the relative orientation of the devices may be estimated based on a phase difference of an acoustic speech signal of the user of the (new) device as received by a first microphone of a first audio receiver device worn at one ear of the user (whose devices already have been admitted to the network) and a second microphone of either the first audio receiver device or of a second audio receiver device worn at the other ear of that user. Depending on the orientation of these microphones, a certain phase difference according to the physical distance of the microphones for a monaural microphone array or a small phase delay (substantially zero) for a binaural microphone array indicates an audio signal from the front.

According to another embodiment, the relative orientation is determined by antenna characteristics of the RF link, where, e.g., an antenna is sensitive substantially only into one direction. Thus only a signal impinging from the preferred direction is detected and exceeds an RSSI threshold.

According to even another embodiment, the relative orientation of the devices is determined by using optical means. According to one example, a camera associated with one of the devices (for example, such camera may be worn at the head of the user of one of the devices in a manner that the camera "looks" into the viewing direction of that user) may be employed to determine the angular position of another one of the devices (i.e., the "new" device) by utilizing appropriate image recognition techniques. According to another example, the "new" device may be provided with a light emitter, e.g., an infrared diode, which transmits (infrared) light substantially into the front direction, with a light detector, e.g., an infrared detector, being associated with another one of the devices (for example, such detector may be worn at the head of the user of that device in a manner that the detector "looks" into the viewing direction of that user, i.e., it is sensitive substantially into the front direction) in order to detect the (infrared) light. The infrared light may be suitably modulated to enable identification vs. other infrared sources.

The relative orientation may also be determined by a combination of the embodiments above.

The field of view of the user of a first device (or a set of first devices) is an angular sector centered around the viewing direction of the user, within which a second device is seen or detected by the first device(s), respectively, where signals associated with the second device (acoustic, electromagnetic, user's voice) fulfill some technical criteria as described above by the examples.

Figure 8:
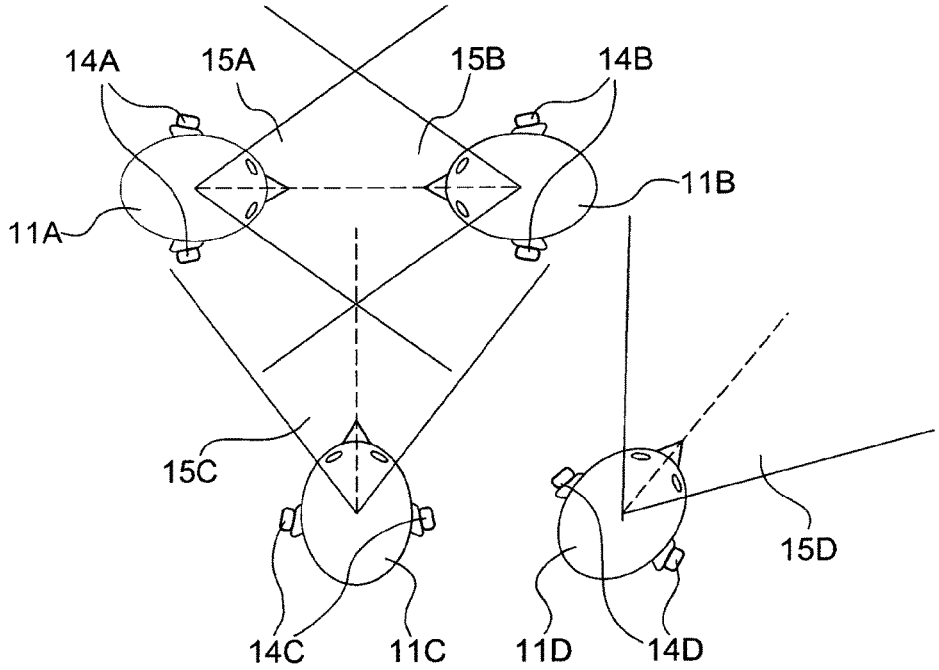
FIG. 8 is a schematic illustration of a LAAN admission rule involving a field of view condition.

The angular sector defining the field of view may be set, for example, to be ±45 degrees, preferably ±30 degrees, with regard to the estimated/determined viewing direction, as illustrated in FIG. 8, which is a schematic illustration of the LAAN admission rule involving a field of view condition, wherein a first user 11A wearing a first pair of hearing devices 14A and a second user 11B wearing a second pair of hearing devices 14B are looking at each other, so that the first pair of devices 14A is within the field of view 15B of the second user 11B and the second pair of devices 14B is within the field of view 15A of the first user 11A (the respective viewing directions of the users are indicated by dashed lines). A third user 11C wearing a third pair of hearing devices 14C is looking laterally at the first user 11A and second user 11B in a manner that the first pair 14A of devices and the second pair 14B of devices both are in the field of view 15C of the third user 11C, while the third pair 14C of devices is neither in the field of view 15A of the first user 14A nor in the field of view 15B of the second user 11B. A fourth user 11D wearing a third pair of hearing devices 14D is oriented such that he is out of any field of view of the other users 11A, 11B, 11C and that none of the other users is in his field of view 15D.

In conformity with the above LAAN admission rules, the devices of the users 11A, 11B and 11C would be admitted to the LAAN, whereas the devices of the user 11D would not be admitted.

Preferably, the LAAN admission rules further include a proximity requirement, i.e., a device is admitted to the LAAN only if the distance of that device to at least one of the devices in the network is below a proximity threshold value. Preferably, the proximity threshold value varies as a function of the estimated environmental sound level around the device, as estimated from the audio signal captured by the respective device. Preferably, the proximity threshold value decreases with increasing estimated environmental sound level. For example, the proximity threshold may vary between 1 m in a very loud environment and 10 m in a very quiet environment. The environmental sound level may be measured during times when a voice activity detector (VAD) of the respective device is not active, i.e., during times when there is no speaker present close to the device.

The mutual distance between the devices may be estimated or computed from the individual positions of the respective users, i.e., the positions of their personal devices, as determined by common position determining methods, such as GPS, BLUETOOTH®-based in-house positioning, (e.g., such as in a technology known as IBEACON® from Apple, Inc.), inertial navigation (dead reckoning), correlation of an acoustically received audio signal (and/or its envelope, at least in specific frequency bands) with an audio signal received via a wireless (i.e., radio frequency (RF)) link to determine either time-of-flight of the acoustically received signal or to identify and map an acoustically received signal to an audio signal received via an RF link, or any suitable combination of such methods. Alternatively, mutual distance of the device may also be estimated from signal strength, such as RSSI ("received signal strength indication") levels (e.g., by evaluating the higher RSSI level from both ears with statistical measures), packet or bit error rates of the RF link, and/or acoustical properties of the received audio signal and any suitable combinations thereof. Typically, a position accuracy of about 0.5 m to 1 m will be sufficient for determining the mutual distances.

Optionally, as a further admission rule, a device may be admitted to the wireless LAAN only if a quality measure of the RF link to one of the devices of the LAAN is above a quality level threshold value.

In general, the admission rules to the network serve to ensure that only those devices which are likely to be of mutual interest, i.e., which are likely to be used to exchange desired audio signals, are admitted to the network, with the combination of spatial proximity of the devices and the viewing directions/fields of view of the users of the devices representing the main contributor indicative of such potential interest, i.e., the "new" device should be in the field of view of the user of a device already admitted to the LAAN, and it preferably should be located close enough to a device already admitted to the LAAN.

Preferably, the network is formed in a master-slave topology, wherein prior to pairing, i.e., before a network is established, each device is provided with its own network ID and an associated frequency hopping sequence, with one of the devices then taking the role of a network master and the other devices taking the role of network slaves using the network ID and frequency hopping sequence received from the device taking the master role. Fully automatic pairing involves a network protocol, such as a Bluetooth link, in a "discoverable mode" with a "just works" pairing method. Any device listening on a broadcast channel may link itself into such an ad-hoc network over a distance typically reachable by a Bluetooth link, e.g., 10 m. Limitation of transmission power in, e.g., loud environments may further limit the number of discoverable devices, as they would not be admittable due to a proximity requirement.

The devices which are within the RF link range and paired with each other then automatically connect to each other on service level to form an ad-hoc network, i.e., they must not (yet) exchange audio data but they are aware of each other and may exchange already other information needed for participating in such a LAAN. Such network parameters/use parameters of the devices may include information with regard to mutual location of the devices, relative orientation of the devices, audio signal-to-noise ratio (SNR), intelligibility index or another suitable quality measure of the audio signal captured by the audio transmission devices, presence of voice in the audio signal captured by the transmission devices and/or speech levels in the audio signal captured by the transmission devices. In order to avoid eavesdropping by unintended listeners, such information may get used to evaluate additional admission rules to get passed, as established by the above discussed admission rules, in order to admit a certain device to the LAAN. In other words, the devices within physical range of the LAAN first form an ad-hoc network to exchange data required to decide on admission of a device to the LAAN.

Once a device has been admitted to the LAAN, the compliance of the device with the admission rules is further monitored, and the device may be removed from the LAAN after a certain timeout time interval, during which the device has failed to fulfill the admission rules, has passed; these timeout intervals may be different for different rules. For example, a device will be removed from the network if more than a given proximity timeout time interval has passed since the distance of the device to at least one of the devices of the network has been above the proximity threshold value for the last time, and the device will be also removed from the network if more than a given field-of-view timeout time interval has passed since at least one of the other devices of the network has been within a field of view of the user of the respective device for the last time (when people stand in a circle for a discussion, their combined field of view is roughly 360°; thus, a certain device is likely to be in field of view of least one of the users of the other devices; however, when the user of a certain device turns away, the other devices are not in his field of view anymore, so that is criterion is a more reliable indicator of a loss of interest in conversation with the other users). Further, a device may be removed from the LAAN if a quality measure of the link between the device and all or some of the devices of the LAAN has not exceeded a link quality threshold for a time interval longer than a link quality timeout threshold value (in practice, there may be some decent combination of the quality of the link to several ones of the devices, taking, e.g., head shadow effects to some devices into account).

The proximity timeout interval and/or the field-of-view timeout time interval may be given as a function of the accumulated time the respective device has already been admitted to the network before. For example, the proximity timeout time interval and/or the field-of-view timeout time interval may increase with increasing accumulated time the respective device has already been admitted to the network before. For example, a person passing by a group of devices in the network may have a timeout of just a few seconds, whereas a longer lasting member of the group may have a timeout of dozens of seconds. Typically, the timeout intervals may be in the range of 1 s to 60 s.

A device not yet admitted to the LAAN or having been removed from the LAAN may be (re)admitted once the admission rules are found to be fulfilled (again).

Once a device has been removed from the ad-hoc network due to too many channel errors it may go back into a discoverable mode in order to be able to either join another existing ad-hoc network or to start a new ad-hoc network or to re-join the former network. In the discoverable mode of a BLUETOOTH® protocol a device broadcasts a regular beacon, whereas the other device is configured to listen to such broadcasts and thus scans the allocated frequency channels for beacons. Since such scanning is relatively power consuming, it is preferred that the device just retains the link keys after it got out of range, so that the devices stay paired and only have to discover themselves to get connected again.

Figure 7:
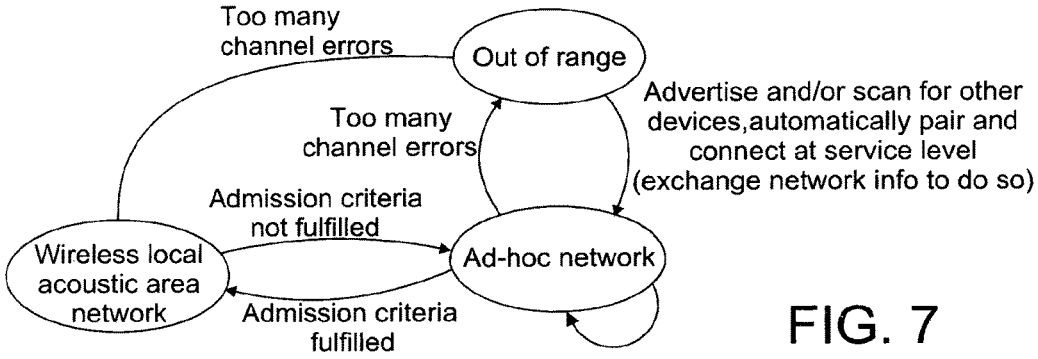
FIG. 7 is a schematic illustration of the network states of a hearing assistance system of the invention.

FIG. 7 is a schematic illustration of the network states of a hearing assistance system, according to which a device may have one of three different states: (1) it may be "out of range", i.e., it is not connected to any device forming part of the LAAN or the ad-hoc network with sufficient link quality (with a link with a low number of channel errors), (2) it may be connected as part of the "ad-hoc network" to other devices, and (3) it may be connected as part of the "wireless LAAN" (this state includes activities like exchanging LAAN admission parameters with the other devices in order to determine admission to LAAN or removal from LAAN; and transmission/reception of audio data (e.g., depending on fulfilment of transmission enable conditions). All states include activities like advertising/scanning for other devices; automatically pairing and connection at service level, including exchanging the respective network information; and exchanging LAAN admission parameters with the other devices in order to determine admission to LAAN or removal from LAAN, so that a new device is able to the network independent of in which state another device is (i.e., a new network may be formed, or an existing network may be joined).

In order to save network resources and avoid congestion, audio transmission by the audio transmission devices admitted to the LAAN preferably is restricted according to audio transmission rules which serve to ensure that only those audio signals are transmitted which are of potential interest to the other participants of the network. In particular, in an automatic transmission enable mode, an audio signal may be transmitted via network only if at least one of the following conditions is fulfilled: the audio signal captured by the respective transmission device is a speech/audio signal having a level above a speech/audio level threshold value, the SNR of the audio signal captured by the respective transmission device is above an SNR threshold value, at least one of the receiver devices is within a given minimum distance to the respective transmission device, an RF link quality measure is above its threshold), a mutual viewing angle between the transmission device user and at least one receiver device user is below a threshold. Preferably, several or all of these conditions have to be fulfilled in order to enable audio transmission.

By applying such transmission enable rules it can be ensured that only relevant audio signals (namely speech from the user of the respective transmission device, as detected by, for example, a VAD) having sufficiently high quality (i.e., having an acceptable SNR) are transmitted to the other devices, with audio transmission being restricted to private communication (due to the proximity and viewing angle requirements). For example, whispering should disable the transmission or at least limit the transmission to the closest vicinity, as the speech level is too low for fulfilling the audio transmission rules, so that a short conversation intended to be private would not be transmitted to other devices. To this end, it is appropriate to select the maximal allowable distance for audio transmission between the devices as a function of the audio signal level or RSSI levels, preferably in function of the environmental signal level. Further, the transmission level of the transmitted audio signal may get limited in dependence of the environmental loudness level in order to reach only devices with sufficient RF link quality which are within the allowed proximity range. That assures furthermore that in loud environments with more independent but smaller LAANs they interfere less with each other.

The estimation of the distance between the devices may occur in the same manner as described with regard to the proximity network admission rule.

The speech/audio level threshold value of the transmission enable rules may depend not only on the environmental noise level, but also on the audio level and/or SNR of other active talkers at their local pickup devices, so that the loudest and best signal may get selected and other audio signals are not sent at all, at least after some initial evaluation period.

According to one embodiment, one of the devices of the network may be adapted to act as a moderator device capable of disabling the audio signal transmission of at least one of the transmission devices in the network, i.e., a transmission device may be muted remotely by a network moderator.

According to another embodiment, at least one of the transmission devices may be provided with a user interface allowing a user to select a manual transmission enable mode as an alternative to the automatic transmission enable mode, in which manual transmission enable mode the device is allowed to transmit its audio signal via the network irrespective of whether the transmission enable rules with regard to speech level, SNR, distance (or RF link quality) and viewing direction, are fulfilled or not.

If audio signals are received from more than one of the transmission devices, the received audio signals are mixed, in the receiver device, by assigning a specific weight to each received audio signal in order to produce an output audio signal, and the produced output audio signal is supplied to the user of the respective receiver device in order to stimulate that user's hearing. While the transmission rules allow the presence of multiple talkers, resulting in the concurrent transmission of multiple audio signals, not every talker is an interesting source to listen to. By applying weighted mixing in such case in the receiver devices, a certain input selection can be implemented. In particular, audio signals from multiple talkers may overlap at least to some extent in time. In such situations mixing of the audio signals prevents cutting away of the first or last syllables of a speaker, thereby enhancing speech intelligibility.

Preferably, the specific mixing weight assigned to each received audio signal is selected as a function of the estimated distance between the respective transmission device and the receiver device receiving the respective audio signal. Preferentially, the specific mixing weight assigned to each received audio signal increases with decreasing estimating distance between the receiver device and the respective transmission device; thereby audio signals from nearer talkers are given a higher weight than audio signals from concurrent more distant talkers. Preferably, the specific mixing weights are normalized so that, for example, a single distant talker is still perceived loud and strong. The normalization value, in turn, may vary upon the number of talkers being mixed, so that the overall loudness impression stays approximately constant.

While such mixing adjustment may occur automatically, there may be also some manual mixing adjustment. For example, a receiver device may comprise a user interface for enabling the user to disable reception of an audio signal from a selected one of the transmission devices or to at least reduce the weight of the audio signal from a selected one of the transmission devices in the output signal. Thereby, a certain talker may be set on a "black list" and reception of his audio signal may be disabled, or a certain dominant talker may be at least attenuated.

According to one example, the specific mixing weight assigned to an audio signal from a transmission device having a larger distance from the receiver device may be increased over the specific mixing weight assigned to an audio signal of a transmission device having a smaller distance from the receiver device in case that mutual viewing angles between the user of the receiver device and the user of the transmission device having the larger distance are detected to be small for a time period exceeding a threshold time interval. Such mixing control is particularly useful for a typical use case when one person talks with another person diagonally across a table while other discussions are ongoing, with the diagonally talking persons not being interested in listening forth and back to the different talkers of the other ongoing discussions.

Figure 2:
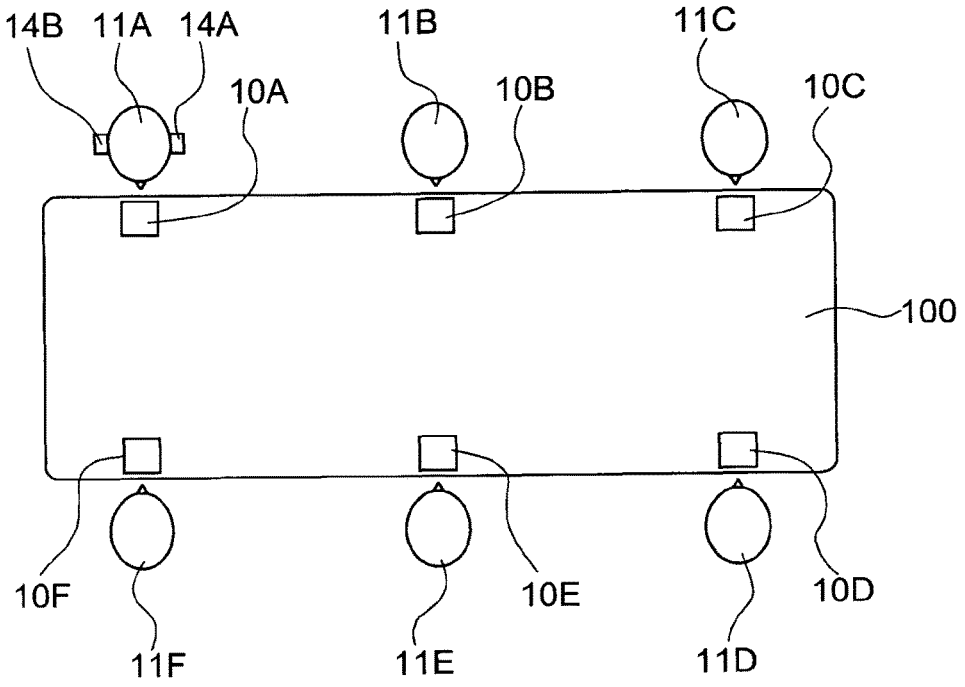
FIG. 2 is a schematic view of an example of a situation where a hearing assistance system according to the invention is applied.

Such a use case is schematically represented in FIG. 2, where a group of persons 11A-11F, each using an audio transmission device 10A-10F acting as wireless microphone, is sitting around a table 100. At least one user 11A is hearing impaired and uses a pair of hearing assistance devices 14A, 14B for receiving audio signals from the transmission devices 10A-10F via a LAAN formed by the audio transmission devices 10A-10F and an audio receiver device suitable to receive the audio signals (such audio receiver may be implemented in the hearing assistance devices 14A, 14B. Likewise, the transmission device 10A may be directly integrated into the hearing assistance devices 14A, 14B (also some or all of the audio transmission devices 10B-10F may be integrated in hearing assistance devices). In the example of FIG. 2, the hearing aid user 11A wishes to talk with a person 11D sitting diagonally across the table 100, with the hearing assistance device user 11A looking at the person 11D.

FIG. 1 is a schematic representation of a hearing assistance system forming a wireless LAAN. The system comprises a plurality of transmission units 10 (which are individually labeled 10A, 10B, 10C), and two receiver units 14 (one labeled 14A connected to or integrated within a right-ear hearing aid 16 and another one labeled 14B connected to or integrated within a left-ear hearing aid 16) worn by a hearing-impaired listener 11D.

Figure 3:
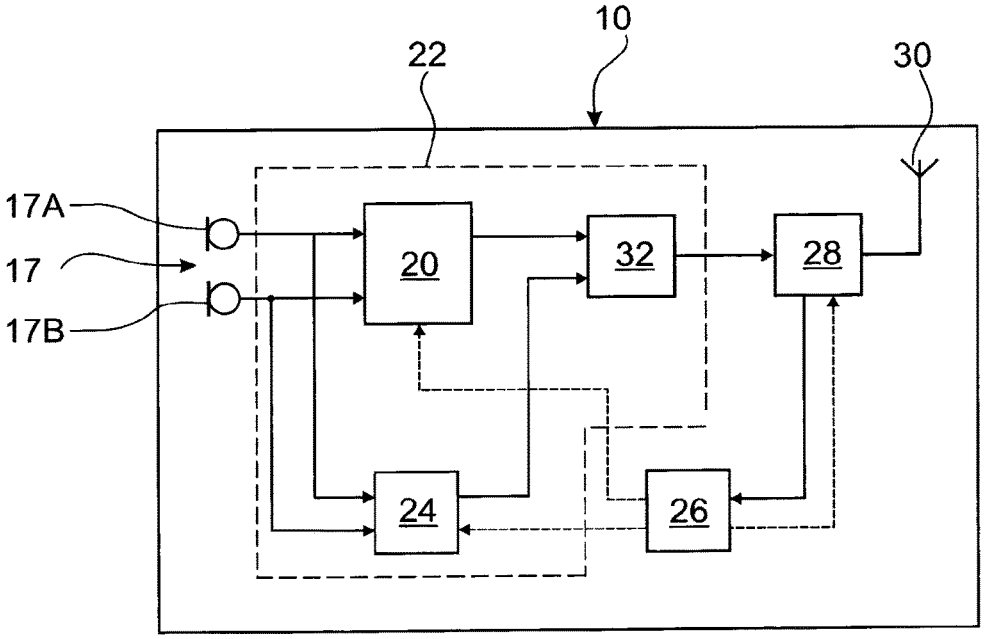
FIG. 3 is a schematic example of a block diagram of an audio transmission device to be used with the invention.

As shown in FIG. 3, each transmission unit 10 comprises a microphone arrangement 17 for capturing audio signals from the respective speaker's 11 voice, an audio signal processing unit 20 for processing the captured audio signals, a digital transmitter 28 and an antenna 30 for transmitting the processing audio signals as an audio stream 19 consisting of audio data packets to the receiver units 14 (in FIG. 1, the audio stream from the transmission unit 10A is labeled 19A, the audio stream from the transmission unit 10B is labeled 19B, etc.). The audio streams 19 form part of a digital audio link 12 established between the transmission units 10 and the receiver units 14A, 14B. The transmission units 10 may include additional components, such as unit 24 comprising a voice activity detector (VAD). The audio signal processing unit 20 and such additional components may be implemented by a digital signal processor (DSP) indicated at 22. In addition, the transmission units 10 also may comprise a microcontroller 26 acting on the DSP 22 and the transmitter 28. The microcontroller 26 may be omitted in case that the DSP 22 is able to take over the function of the microcontroller 26. Preferably, the microphone arrangement 17 comprises at least two spaced-apart microphones 17A, 17B, the audio signals of which may be used in the audio signal processing unit 20 for acoustic beamforming in order to provide the microphone arrangement 17 with a directional characteristic. Alternatively, a single microphone with multiple sound ports or some suitable combination thereof may be used as well.

The unit 24 uses the audio signals from the microphone arrangement 17 as an input in order to determine the times when the person 11 using the respective transmission unit 10 is speaking, i.e., the unit 24 determines whether there is a speech signal having a level above a speech level threshold value. The unit 24 may also analyze the audio signals in order to determine the SNR of the captured audio signal in order to determine whether it is above an SNR threshold value.

An appropriate output signal of the unit 24 may be transmitted via the wireless link 12. To this end, a unit 32 may be provided which serves to generate a digital signal merging a potential audio signal from the processing unit 20 and data generated by the unit 24, which digital signal is supplied to the transmitter 28.

In practice, the digital transmitter 28 is designed as a transceiver, so that it cannot only transmit data from the transmission unit 10 to the receiver units 14A, 14B, but also receive data and commands sent from other devices in the network. The transceiver 28 and the antenna 30 form part of a wireless network interface.

According to one embodiment, the transmission units 10 may be adapted to be worn by the respective speaker 11 at the speaker's ears such as a wireless earbud or a headset. According to another embodiment, the transmission units 10 may form part of an ear-level hearing device, such as a hearing aid.

Figure 4:
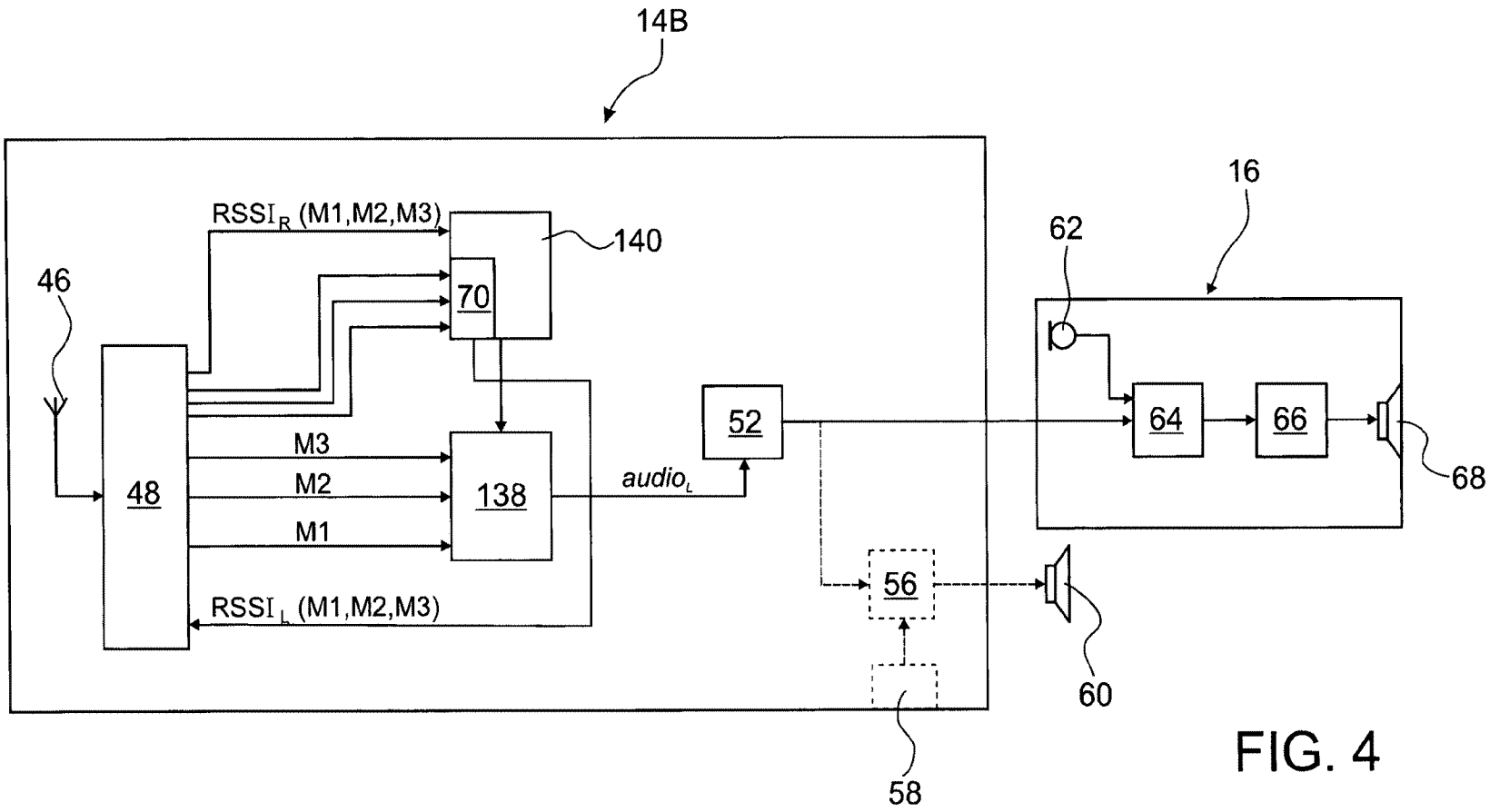
FIG. 4 are a schematic example of an audio receiver device to be used with the invention.

An example of the audio signal paths in the left ear receiver unit 14B is shown in FIG. 4, wherein the transceiver 48 receives the audio signals transmitted from the transmission unit 10 via the digital link 12, i.e., it receives and demodulates the audio signal streams 19A, 19B, 19C transmitted from the transmission units 10A, 10B, 10C into respective output signals M1, M2, M3 which are supplied as separate signals, i.e., as three audio streams, to an audio signal processing unit 38. In addition, the received audio signals are also supplied to a signal strength analyser unit 70 which determines the RSSI value of the RF signals from each of the transmission units 10A, 10B, 10C separately, wherein the output of the unit 70 is supplied to the transceiver 48 for being transmitted via the antenna 46 to the other receiver unit, i.e., to the right ear receiver unit 14A (in FIG. 7, the output of the RF signal strength analyzer unit 70 is indicated by "$RSSI_L$").

The output of the unit 70 is also supplied to an angular localization estimation unit 140. The transceiver 48 receives the right ear RF signal measurement data, i.e., the RF signal level $RSSI_R$ of each of the transmission units 10A, 10B, 10C, from the other receiver unit, i.e., the right ear receiver unit 14A, and the respective demodulated signal is supplied to the angular localization estimation unit 140. Hence, the angular localization estimation unit 140 is provided with the left ear RF signal measurement data and the right ear RF signal measurement data, i.e., with the RSSI values $RSSI_R$ and $RSSI_L$ respectively other suitable link quality measures, in order to estimate the angular localization of each transmission unit 10A, 10B, 10C by comparing the respective right ear link quality measures and the left ear link quality measures. The complementary right ear channel of such stereo audio signal is generated simultaneously by the right receiver unit 14A in an analogous manner.

Figure 6:
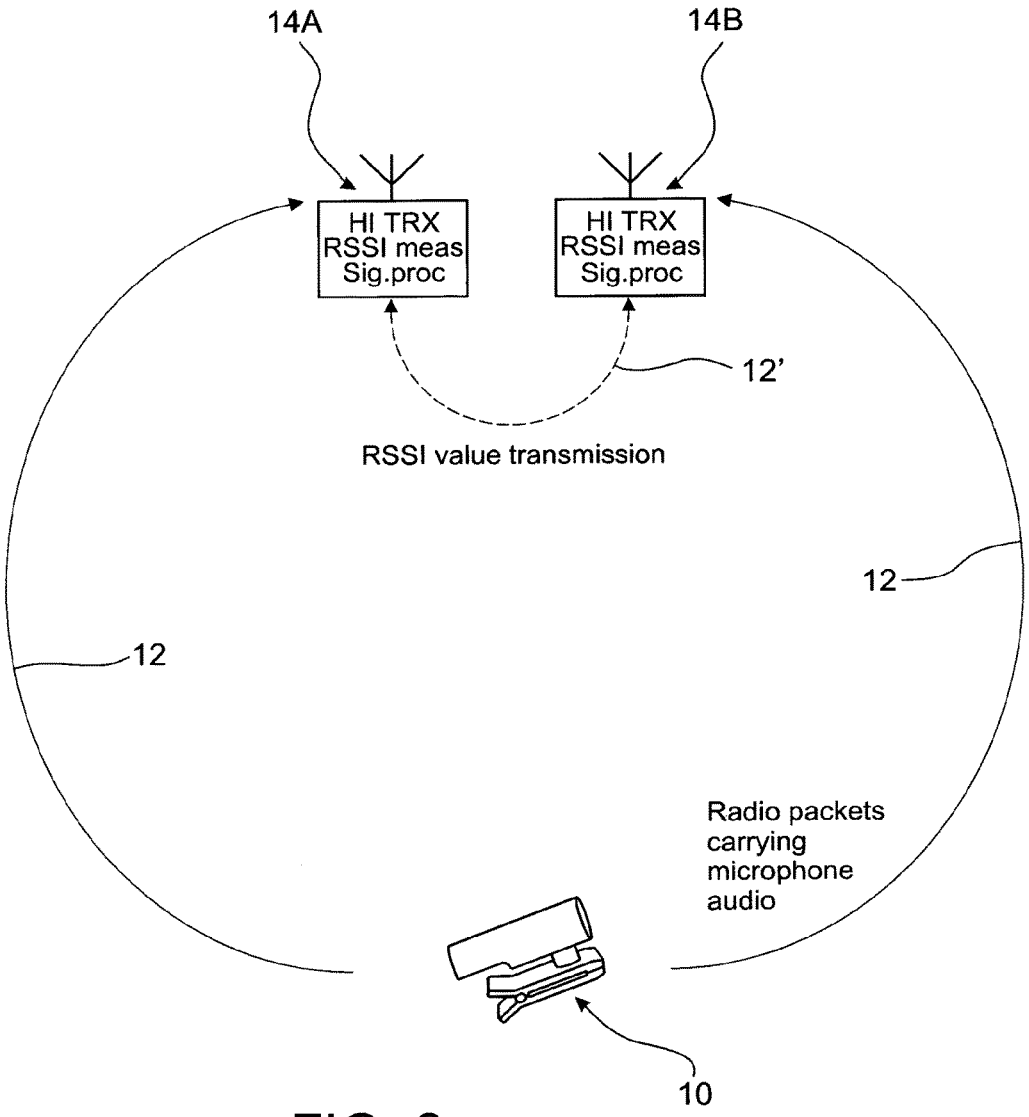
FIG. 6 is a schematic illustration of the wireless signal exchange in a hearing assistant system of the invention.

The data exchange between an audio transmission unit 10 and binaural audio receiver devices 14A, 14B is schematically illustrated in FIG. 6.

The processed left ear channel audio signals $audio_L$, are supplied, to an amplifier 52. The amplified audio signals may be supplied to a hearing aid 16 including a microphone 62, an audio signal processing unit 64, and amplifier and an output transducer (typically a loudspeaker 68) for stimulating the user's hearing. The receiver unit 14B may at least in part be fully integrated into an ear level device such as a hearing aid, etc. It is to be noted that such microphone 62 may serve to capture the voice of the user of the receiver unit 14B in order to enable the receiver unit 14B act as an audio transmission device for transmitting such audio signals via the transceiver 48 and the link 12 to other ear level hearing devices of the LAAN.

Rather than supplying the audio signals amplified by the amplifier 52 to the input of a hearing aid 16, the receiver unit 14 may include an audio power amplifier 56 which may be controlled by a manual volume control 58 and which supplies power amplified audio signals to a loudspeaker 60 which may be an ear-worn element integrated within or connected to the receiver unit 14.

While in FIG. 4 only the left ear receiver unit 14B is shown, it is to be understood that the corresponding right ear receiver unit 14A has an analogous design, wherein the right ear audio signal channel $audio_R$ is received, processed and supplied to the hearing aid 16 or to the speaker 60

Figure 5:
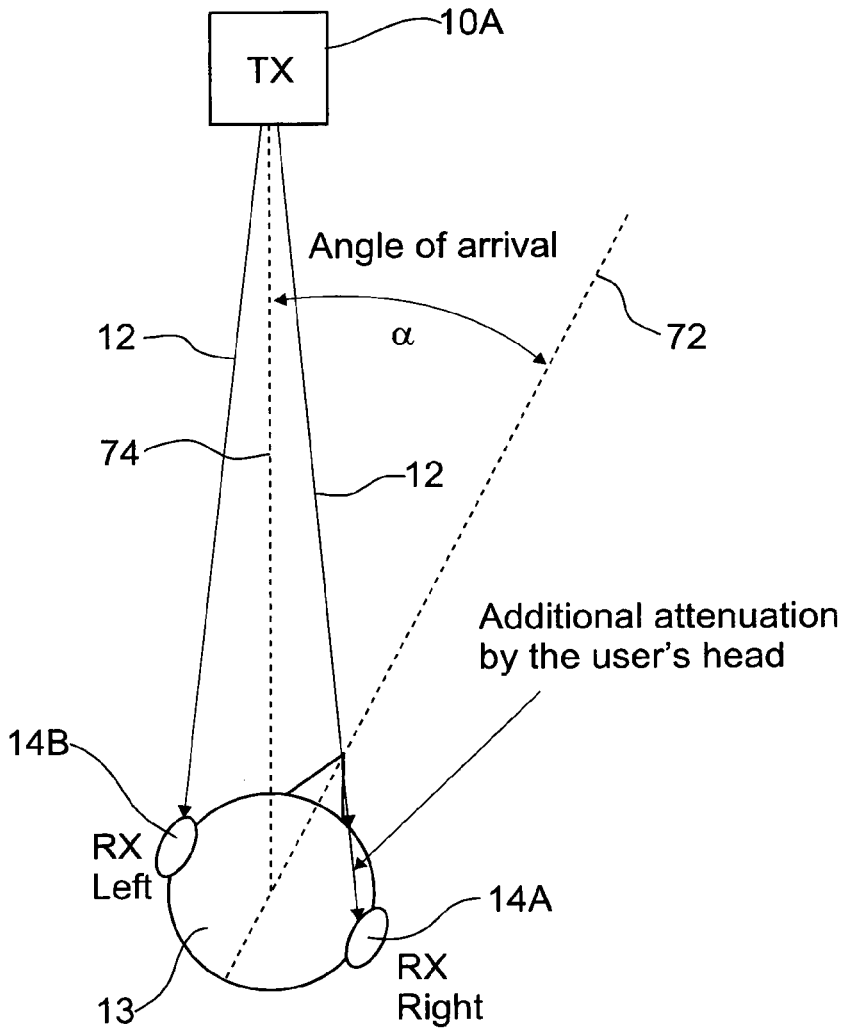
FIG. 5 is an illustration of a principle of determining a viewing direction of a user of a binaural audio receiving arrangement based on interaural radio signal strength differences.

The principle of angular localization estimation (as it may be used by the angular localization estimation unit 140) is illustrated in FIG. 5. The RF signals 12 transmitted by one of the transmission units (in FIG. 5 the transmission unit 10A is shown) are received by the right ear receiver unit 14A and the left ear receiver unit 14B at a level depending on the angle of arrival $\alpha$ in a horizontal plane formed between the looking direction 72 of the user (i.e., a direction in a horizontal plane and perpendicular to the line connecting the two ears of the user 13) and a line 74 connecting the transmission unit 10A to the centre of the head of the user 13 (typically, the vertical position of the transmission unit 10A will be close to the vertical position of the user's head, so that the viewing direction 72 and the line 74 may be considered as being located in the same horizontal plane). The reason is that once the angle $\alpha$ deviates from zero (i.e., when the user 13 looks into a direction different from the direction 74 of the transmission unit 14A), due to the absorption of RF signals by the user's head, the RF signals 12 will be received at the right ear receiver unit 14A and at the left ear receiver unit 14B at different levels; in the example of FIG. 5, the RF signal level as received by the right ear receiver unit 14A will be lower than the RF signal level received at the left ear receiver unit 14B. In general, the signal at that side of the user's head which is in the "shadow" with regard to the transmission unit 10A will receive a weaker RF signal.

Hence, by comparing the RF signal strength as received by the right ear receiver unit 14A and the RF signal strength received at the left ear receiver unit 14B, for example by comparing the respective RSSI values, packet or bit error rates or another suitable link quality measure, for a given RF signal source, i.e., for one of the transmission units 10, it is possible to estimate the angular localization, i.e., the angle of arrival $\alpha$ for each of RF signal source, i.e., for each of the transmission unit 10. Although the correlation between the signal strength and the angle of arrival in practice may be quite complex, it has been found that it will be possible to distinguish at least some coarse angular regions like "left", "centre-front" and "right". In general, the reliability of the angle of arrival estimation will be deteriorated by the occurrence of reflected RF signals (such reflexions, for example, may occur at walls, metallic ceilings or metallic white boards close to the user's head or in situations where the RF signal source is not in line of sight with regard to the user's head). The angle of arrival estimation will also be deteriorated if both receivers 14A and 14B do not provide the same RSSI reading output to a given reference signal. In practice this problem can be solved by a proper calibration of the RSSI readout during manufacturing of the receivers.

Given a known transmission power, by analysing the RSSI values, it is also possible to estimate the distance between the transmission device 10A and the receiver devices 14A, 14B in absolute terms.

Typically, the carrier frequencies of the RF signals are above 1 GHz. In particular, at frequencies above 1 GHz the attenuation/shadowing by the user's head is relatively strong. Preferably, the digital audio link 12 is established at a carrier-frequency in the 2.4 GHz ISM band. Alternatively, the digital audio link 12 may get established at carrier-frequencies in the 868 MHz or 915 MHz bands, or in as an UWB-link in the 6-10 GHz region.

The digital link 12 preferably uses a TDMA schedule with frequency hopping, wherein each TDMA slot is transmitted at a different frequency selected according to a frequency hopping scheme. In particular, each transmission unit 10 transmit each audio data packet in at least one allocated separate slot of a TDMA frame at a different frequency according to a frequency hopping sequence, wherein certain time slots are allocated to each of the transmission unit 10, and wherein the RF signals from the individual transmission units 10A, 10B, 10C are distinguished by the receiver units 14A, 14B by the time slots in which they are received.

The transmission units 10A, 10B, 10C and the receiver devices 14A and 14B may automatically form a LAAN according to the above-mentioned procedures, i.e., by connecting to each other according to the network admission rules, with the transmission activity being controlled according to the transmission enable rules, wherein one of the devices, acts as the master and the other network participants acting as slaves. The above described angular localization procedure serves to determine the viewing direction of the user of the hearings aids 16 in order to determine which ones of the transmission devices 10A-10C are to be admitted into the network and which ones of the transmission devices 10A-10C are allowed to transmit audio signals.

It is to be mentioned that, as an alternative to the above-described methods for estimating the angular localization of the RF transmission units, in principle one could measure the RF signal time of arrival at each of the receiver units 14A, 14B and estimate the angular of arrival from the time delay obtained by comparing the time of arrival at the right ear receiver unit 14A and the left ear receiver unit 14B. However, in this case it would be necessary to provide for a precise common time base for measuring the time of flight of the RF signals. Such precise common time base requires a complex mechanism of query/answer signals exchange between the two receiver units 14A, 14B and a very precise clock in each receiver unit 14A, 14B, which, in turn, may result in relatively high power consumption and size. Alternatively, the common time base could be transmitted from another device which has to be placed at the same distance to the right ear receiver unit 14A and the left ear receiver unit 14B, which arrangement may be cumbersome in practice.

As a further alternative, one may measure the phase difference between the RF signals at the two receiver units 14A, 14B at the same frequency by using a mixer. However, in practice this may be difficult, since it requires a phase reference for both receiver units 14A, 14B. As a further alternative, e.g., a transmission unit may transmit an RF signal burst to both receiver devices 14A and 14B, which both send the RF signal burst back with a known exact delay. The transmission unit then may compare the time-of-flight of both received answers and subtract the individual delays of the receiver devices 14A and 14B in order to determine the pure forth and back flight time. Therefrom it can estimate the distance to both devices as well as the angular orientation of the two receiver devices and transmit that information back over a control channel.

If the received RF signal bursts have special properties such as increasing frequency (chirp), the transmission device may also correlate them with each other and/or with the transmitted signal having the same properties in order to determine distance and/or angular localisation.

In general, at least one parameter of the RF signal (such as amplitude, phase, delay, i.e., arrival time), and correlation of the demodulated received audio signal with the acoustic signal from a local microphone is measured both at the right ear receiver unit 14A and at the left ear receiver unit 14B, in order to create right ear signal measurement data and left ear signal measurement data, which then are compared for estimating the angular localization of the transmission unit.

In the hearing assistance systems according to the invention, distances between the transmission unit(s) and the receiver units typically are from 1 to 20 m.

According to one example, an audio transmission device—or an audio receiver Device—may reduce its transmission power in dependence on a sensed environmental noise level. This applies both to the transmission of audio data by an audio transmission and to other data transmission required for communication (e.g., for detection of and admission to an ad-hoc network or a LAAN) by both transmission and receiver devices. Typically, the transmission power level will be reduced with increasing noise level, in order to not reach too far, as more independent LAANs will be around. At the same time, such reduced transmission power is a natural and simple method to remove 'uncooperative' devices from the LAAN.

What is claimed is:

1. A method of providing hearing assistance to a at least one user wearing at least one receiver hearing assistance device capable of receiving audio signals via a radio frequency (RF) link from at least one audio transmission device worn by another user, and capable of transmitting audio signals, each device comprising a wireless network interface, the method comprising:

automatically pairing and connecting the at least one audio transmission device on a service level with the at least one receiver hearing assistance device through the wireless network interface thereof to form an ad hoc network to exchange at least one of network and control information, estimating at least one of an angular direction of the at least one audio transmission device with regard to a viewing direction of the user of the at least one receiver hearing assistance device and an angular direction of the at least one receiver hearing assistance device with regard to a viewing direction of the user of the at least one audio transmission device, and admitting the at least one audio transmission device to a wireless local acoustic area network for exchanging audio signals with the at least one receiver hearing assistance device only if, as a predefined admission rule, the at least one transmission device is within a field of view of the user of the at least one receiver hearing assistance device or the at least one receiver hearing assistance device is within a field of view of the user of the at least one audio transmission device, wherein the field of view is an angular sector centered around the respective viewing direction.

2. The method of claim 1, wherein, as a further admission rule, the at least one audio transmission device is admitted to the wireless local acoustic area network only if the distance of the at least one audio transmission device to at least one of the at least one receiver hearing assistance devices of the wireless local acoustic area network is below a proximity threshold value and/or a quality measure of the RF link to one of the devices of the wireless local acoustic area network is above a quality level threshold value.

3. The method of claim 2, wherein the proximity threshold value and/or the quality level threshold value varies as a function of an estimated environmental sound level around the device as estimated from the audio signal captured by the respective device.

4. The method of claim 3, wherein, with increasing the estimated environmental sound level, the proximity threshold value decreases and the quality level threshold value increases, respectively.

5. The method of claim 2, wherein the proximity threshold value varies between 1 m and 10 m.

6. The method of claim 2, wherein a device is removed from the local acoustic area network if none of the other devices of the local acoustic area network has been within the field of view of the user of the device for a time interval longer than a field-of-view timeout threshold value, or if the device has exceeded the proximity threshold with regard to at least one of the devices of the local acoustic area network for a time interval longer than a proximity timeout threshold value, or if an RF link quality measure between the device and all devices of the local acoustic area network has not exceeded the RF link quality threshold for a time interval longer than a RF link quality timeout threshold value.

7. The method of claim 6, wherein the proximity timeout threshold, the field-of-view timeout threshold and the RF link quality timeout threshold values are all different.

8. The method of claim 7, wherein at least one the proximity timeout threshold, the field-of-view timeout threshold and the RF link quality timeout threshold values are given as a function of an accumulated time that a respective device has already been previously admitted to the local acoustic area network.

9. The method of claim 8, wherein the proximity timeout threshold and/or the field-of-view timeout threshold and/or the RF link quality timeout threshold value increase with increasing accumulated time the respective device has already been admitted to the LAAN before.

10. The method of claim 7, wherein at least one of the timeout thresholds is between 1 s and 60 s.

11. The method of claim 10, wherein the at least one receiver device comprises a user interface for enabling the user to disable reception of the audio signal from a selected one of the transmission devices or to at least reduce the weight of the audio signal from a selected one of the transmission devices in the output signal.

12. The method of claim 1, wherein the at least one receiver hearing assistance device is a device adapted to be worn at or at least in part in an ear of the user, and wherein the at least one receiver hearing assistance device comprises pairs of receiver hearing assistance devices, each pair forming a binaural system.

13. The method of claim 12, wherein said angular direction of the transmission device with regard to the viewing direction of the user of the pair of receiver devices is estimated based on a difference of a signal strength parameter of an RF signal emitted by the respective transmission device and received by a first one of the pair of receiver devices worn at first ear of the user and a second of the pair of receiver devices worn at a second ear of the user.

14. The method of claim 12, wherein said angular direction of the at least one transmission device with regard to the viewing direction of the user of the pair of receiver devices is estimated based on a phase difference of an acoustic speech signal of the user of the respective transmission device as received by a first microphone of a first one of the pair of receiver devices worn at one ear of the user and a second microphone of either the first or a second one of the pair of receiver devices worn at the other ear of the user.

15. The method of claim 1, further comprising:

transmitting, from each audio transmission device admitted to the local acoustic area network, an audio signal via the wireless local acoustic area network only if at least one of the following transmission rules is fulfilled:

the audio signal captured by the respective audio transmission device has a level above an audio level threshold value, an audio signal quality measure, such as a signal to noise ratio, of the audio signal captured by the respective audio transmission device is above an audio signal quality measure threshold value, a distance measure between the audio transmission device and at least one of the receiver devices of the local acoustic area network is below a distance threshold value, a quality measure of the RF link to at least one of the receiver hearing assistance devices of the local acoustic area network is above an RF link quality threshold value, and the transmission device is within a field of view of the at least one user of at least one of the receiver hearing assistance devices of the local acoustic area network and said at least one of the receiver hearing assistance devices is within a field of view of the user of the audio transmission device, wherein the field of view is an angular sector centered around the respective viewing direction of the user;

receiving, by at least one of the receiver hearing assistance devices, audio signals transmitted from the audio transmission devices, generating an output audio signal, and supplying the output audio signal to the user of the receiver hearing assistance device in order to stimulate the user's hearing, wherein, if audio signals are received from more than one of the transmission devices, the received audio signals are mixed by assigning a specific weight to each received audio signal in order to produce the output audio signal.

16. The method of claim 15, wherein each audio transmission device is allowed to transmit its audio signal via the wireless local acoustic area network only if at least three of said transmission rules are fulfilled for the respective audio transmission device.

17. The method of claim 15, wherein at least one of the audio level threshold value and the audio signal quality level threshold value depends on an environmental noise level estimated from audio signals captured by one of the at least one transmission device.

18. The method of claim 15, wherein one of the devices of the local acoustic area network is adapted to act as a moderator device capable of disabling the audio signal transmission of at least one of the transmission devices in the local acoustic area network.

19. The method of claim 15, wherein a specific mixing weight assigned to each received audio signal in the mixing for producing the output audio signal is selected as a function of at least one of an estimated distance and a RF link quality measure between the at least one receiver device and the transmission device of the respective received audio signal.

20. Previously Presented) The method of claim 19, wherein the specific mixing weight assigned to each received audio signal increases with decreasing estimated distance between the at least one receiver device and the transmission device of the respective received audio signal.

21. The method of claim 15, wherein the specific mixing weights are normalized.

22. The method of claim 15, where the specific mixing weight assigned to an audio signal from a transmission device having a larger distance or lower RF link quality measure from the receiver device is increased over the specific mixing weight assigned to an audio signal of a transmission device having a smaller distance or higher RF link quality measure from the receiver device if the angle between the viewing directions of the users of the receiver device and the transmission device having the larger distance is detected for a time period to stay below a threshold.

23. The method of claim 15, wherein, as a further admission rule, the at least one audio transmission device is admitted to the wireless local acoustic area network only if the distance of the at least one audio transmission device to at least one of the at least one receiver hearing assistance devices of the wireless local acoustic area network is below a proximity threshold value and/or a quality measure of the RF link to one of the devices of the wireless local acoustic area network is above a quality level threshold value, wherein the distance of a transmission device to a receiver device or one of the receiver devices is estimated based on a respective individual position as determined by a position determining method.

24. The method of claim 15, wherein, as a further admission rule, the at least one audio transmission device is admitted to the wireless local acoustic area network only if the distance of the at least one audio transmission device to at least one of the at least one receiver hearing assistance devices of the wireless local acoustic area network is below a proximity threshold value and/or a quality measure of the RF link to one of the devices of the wireless local acoustic area network is above a quality level threshold value, wherein the distance of a transmission device to a receiver device or one of the receiver devices is estimated by analyzing an acoustic speech signal of a user of the transmission device as received by the receiver device.

25. The method of claim 15, wherein, as a further admission rule, the at least one audio transmission device is admitted to the wireless local acoustic area network only if the distance of the at least one audio transmission device to at least one of the at least one receiver hearing assistance devices of the wireless local acoustic area network is below a proximity threshold value and/or a quality measure of the RF link to one of the devices of the wireless local acoustic area network is above a quality level threshold value, wherein the distance of a transmission device to a receiver device or one of the receiver devices is estimated by analyzing an RF signal sent from the transmission device to receiver devices worn at both ears of a user.

26. The method of claim 1, wherein the at least one audio transmission device is provided with a user interface allowing a user to select a manual transmission enable mode as an alternative to an automatic transmission enable mode allowing the audio transmission device to transmit its audio signal only if predefined transmission rules are fulfilled, in which manual transmission enable mode the device is allowed to transmit its audio signal via the network irrespective of the transmission rules of the automatic transmission enable mode.

27. The method of claim 1, wherein a transmission power of the network interface of the at least one audio transmission device or of the at least one receiver device is reduced with an increasing environmental noise level estimated from audio signals captured by the respective device or another one of the devices.

28. The method of claim 1, wherein the at least one hearing assistance device is one of a hearing aid, an auditory prosthesis, a wireless earbud, a headset and a headphone.

29. The method of claim 1, wherein the at least one transmission device comprises a microphone and is one of a wireless earbud, a headset, a headphone, a hearing aid and an auditory prosthesis.

30. The method of claim 1, wherein the at least one audio transmission device is a device adapted to be worn at or at least in part in an ear of the user, and wherein the at least one audio transmission device is a plurality of audio transmission devices provided in pairs, each pair forming a binaural system.

31. A hearing assistance system comprising:

at least one audio transmission device capable of capturing an audio signal from a person's voice and at least one hearing assistance device to be worn by a user for receiving audio signals from the at least one audio transmission device, each of the at least one hearing assistance device and the at least one audio transmission device comprising a wireless network interface for establishing a wireless local acoustic area network, the at least one hearing assistance device and the at least one audio transmission device devices being adapted to automatically pair to form an ad hoc network and to connect, once paired, on a service level in order to exchange at least one of network and control information, the at least one hearing assistance device and the at least one audio transmission device being adapted to estimate at least one of an angular direction of the audio transmission device with regard to a viewing direction of the user of the receiver hearing assistance device and an angular direction of the receiver hearing assistance device with regard to a viewing direction of the user of the audio transmission device, and the at least one hearing assistance device and the at least on audio transmission device adapted to admit the audio transmission device to a wireless local acoustic area network for exchanging audio signals with the receiver hearing assistance device only if, as a predefined admission rule, the transmission device is within a field of view of the user of the receiver hearing assistance device or the receiver hearing assistance device is within a field of view of the user of the audio transmission device, wherein the field of view is an angular sector centered around the respective viewing direction.

* * * * *